United States Patent [19]

Hansel et al.

[11] 4,222,856

[45] Sep. 16, 1980

[54] METHOD FOR PROMOTING REGENERATION OF A CATALYST IN A FLUIDIZED REGENERATOR

[75] Inventors: John H. Hansel, Media; Robert G. Linton, Orefield, both of Pa.; Charles W. Stanger, Jr., Brookfield, Ill.

[73] Assignee: Air Products and Chemicals, Inc., Allentown, Pa.

[21] Appl. No.: 805,193

[22] Filed: Jun. 9, 1977

[51] Int. Cl.[3] ..... C10G 11/02; C01B 31/18; B01J 23/92; B01J 23/42

[52] U.S. Cl. ..... 208/120; 55/2; 208/113; 208/122; 208/159; 208/161; 208/164; 252/417; 423/246; 423/437

[58] Field of Search ..... 208/113–127; 252/412–417

[56] References Cited

U.S. PATENT DOCUMENTS

| | | | |
|---|---|---|---|
| 2,436,927 | 3/1948 | Kassel | 252/417 |
| 3,340,012 | 9/1967 | Moehl | 423/651 |
| 3,364,136 | 1/1968 | Chen et al. | 208/120 |
| 3,788,977 | 1/1974 | Dolbear et al. | 208/120 |
| 3,816,344 | 6/1974 | Shimizu et al. | 252/455 R |
| 3,909,392 | 9/1975 | Horecky et al. | 208/120 |
| 3,926,843 | 12/1975 | Owen | 252/417 |
| 4,064,039 | 12/1977 | Penick | 208/160 |
| 4,072,600 | 2/1978 | Schwartz | 208/120 |
| 4,115,250 | 9/1978 | Flanders et al. | 208/120 |
| 4,118,430 | 10/1978 | Mooi | 208/120 X |
| 4,148,751 | 4/1979 | Hemler et al. | 208/113 X |
| 4,153,535 | 5/1979 | Vasalos et al. | 208/120 |

FOREIGN PATENT DOCUMENTS

| | | | |
|---|---|---|---|
| 820181 | 9/1974 | Belgium | 208/120 |
| 2444911 | 4/1975 | Fed. Rep. of Germany | 208/120 |
| 2507343 | 9/1975 | Fed. Rep. of Germany | 208/120 |
| 1178594 | 1/1970 | United Kingdom | 208/120 |
| 1499682 | 3/1974 | United Kingdom | 208/120 |

*Primary Examiner*—Delbert E. Gantz
*Assistant Examiner*—G. E. Schmitkons
*Attorney, Agent, or Firm*—Russell L. Brewer; Barry Moyerman

[57] ABSTRACT

A promoter comprising from about 500 ppm to about 1% of a Group V, Group VI, or Group VIII metal on a support is combined with a hydrocarbon conversion catalyst under fluidizing conditions, in an effective proportion, to enhance the removal of carbonaceous material from the catalyst. Typically, the promoter is a mixture of platinum and palladium supported on gamma alumina and is included in a fluidized catalytic cracking (FCC) unit in a sufficient proportion to provide from about 0.05 to about 50 ppm metal based on the weight of the catalyst.

4 Claims, 1 Drawing Figure

METHOD FOR PROMOTING REGENERATION OF A CATALYST IN A FLUIDIZED REGENERATOR

BACKGROUND OF THE INVENTION

1. Field of the Invention

This invention relates to an improvement in hydrocarbon conversion processes wherein a catalyst is contacted with a hydrocarbon feedstock in a reactor under fluidizing conditions and then removed and sent to a regenerator for removal of carbonaceous material therefrom while under fluidizing conditions.

2. Discription of the Prior Art

U.S. Pat. No. 2,913,402 discloses a fluid catalytic cracking process which comprises hydroforming hydrocarbon fractions by contacting the hydrocarbon fractions with a catalyst comprising molybdenum oxide supported on alumina. The main idea in the patent is to eliminate the loss of molybdenum oxide catalyst in the regenerator and the idea comprises cooling the regenerator in the dilute phase of the upper part of a regeneration zone to a temperature below 1000° F.

U.S. Pat. No. 3,808,121 describes a regeneration process for a hydrocarbon conversion catalyst used in a fluidized catalytic cracking unit. In the regeneration process, solid form cracking catalyst is subjected to exothermic reaction conditions in the presence of solids of larger particle size, e.g. Berl saddles and Raschig rings. The large size particles comprise a carbon monoxide oxidation catalyst and act as a heat sink. In operation, the finely divided cracking catalyst is passed through the voids in the oxidation catalyst wherein the carbonaceous material is removed.

U.S. Pat. No. 3,235,512 discloses that platinum supported on silica, alumina and gamma alumina catalysts can be used in reforming gasolines and naphtha fractions, but that the mechanical strength of the catalyst is undesirable.

Belgian Pat. No. 820,181 relates to an improved (promoted) cracking catalyst for a fluidized bed cracking process. The gist of the disclosure is that a Group V, Group VI, or Group VIII metal, preferably platinum, when incorporated into a cracking catalyst in a proportion of from about 0.1 to 50 ppm enhances the oxidation of carbonaceous material from the cracking catalyst during regeneration while not substantially affecting the performance thereof.

U.S. Pat. No. 3,856,659 discloses a multiple reactor fluid catalytic cracking system which uses a dual cracking catalyst composition. The dual cracking catalyst comprises a cracking catalyst having a relatively large pore size and one having a relatively small pore size,, generally of a crystalline alumino-silicate composition.

SUMMARY OF THE INVENTION

A finely divided promoter comprising from about 500 ppm to about 1% of a Group V, Group VI, or Group VIII metal having an atomic number of from 24 to 78 and carried on a catalytic support is added to a hydrocarbon catalytic conversion process employing a reactor and regenerator. This is done for the purpose of enhancing removal of carbonaceous material present on the hydrocarbon conversion catalyst in the regenerator without substantially altering the characteristics and performance of the hydrocarbon conversion catalyst. Typically, the promoter is included in a proportion to provide about 0.1 to 50 ppm metal based on the weight of the catalyst, and broadly, in an amount effective to enhance removal of carbonaceous material.

Significant advantages are obtained by employing the promoter as described in a hydrocarbon conversion process, e.g. a fluid catalytic cracking unit. These advantages include:

a flexibility in hydrocarbon processing in that the ratio of promoter to catalyst can be adjusted with great facility to alter the carbon monoxide/carbon dioxide ratio in the regenerator and thus move from an unpromoted to a promoted regeneration and vice versa;

the ability to alter temperatures in the regenerator to satisfy heat requirements and maintain stability in the reactor;

a flexibility in the purchasing of catalysts as promoted catalysts were often unsuited for the processing of multiple feedstocks;

a flexibility in eliminating substantial storage capacity for the catalyst and FCC down time when moving to an unpromoted system;

the ability to control the residence time of the promoter in the regenerator-reactor thereby providing greater flexibility of operation than processes employing large diameter oxidation catalyst which are retained in the regenerator;

the ability to tailor the promoters with a variety of supports and obtain enhanced flexibility of operation, for example, the ability to tailor a VIII metal into a frangible support (gamma alumina) which can break up by the fluidizing process and be removed from the system within a short period of time; and the ability to minimize the tieing of substantial amounts of capital in raw material components in view of the fact small amounts of promoter are used based on the weight of the catalyst.

BRIEF DESCRIPTION OF THE DRAWING

The single FIGURE is a diagrammatic arrangement in elevation of a hydrocarbon conversion reactor-regenerator system as found in a conventional fluid catalytic cracking unit.

DESCRIPTION OF THE PREFERRED EMBODIMENT

Figure 1:
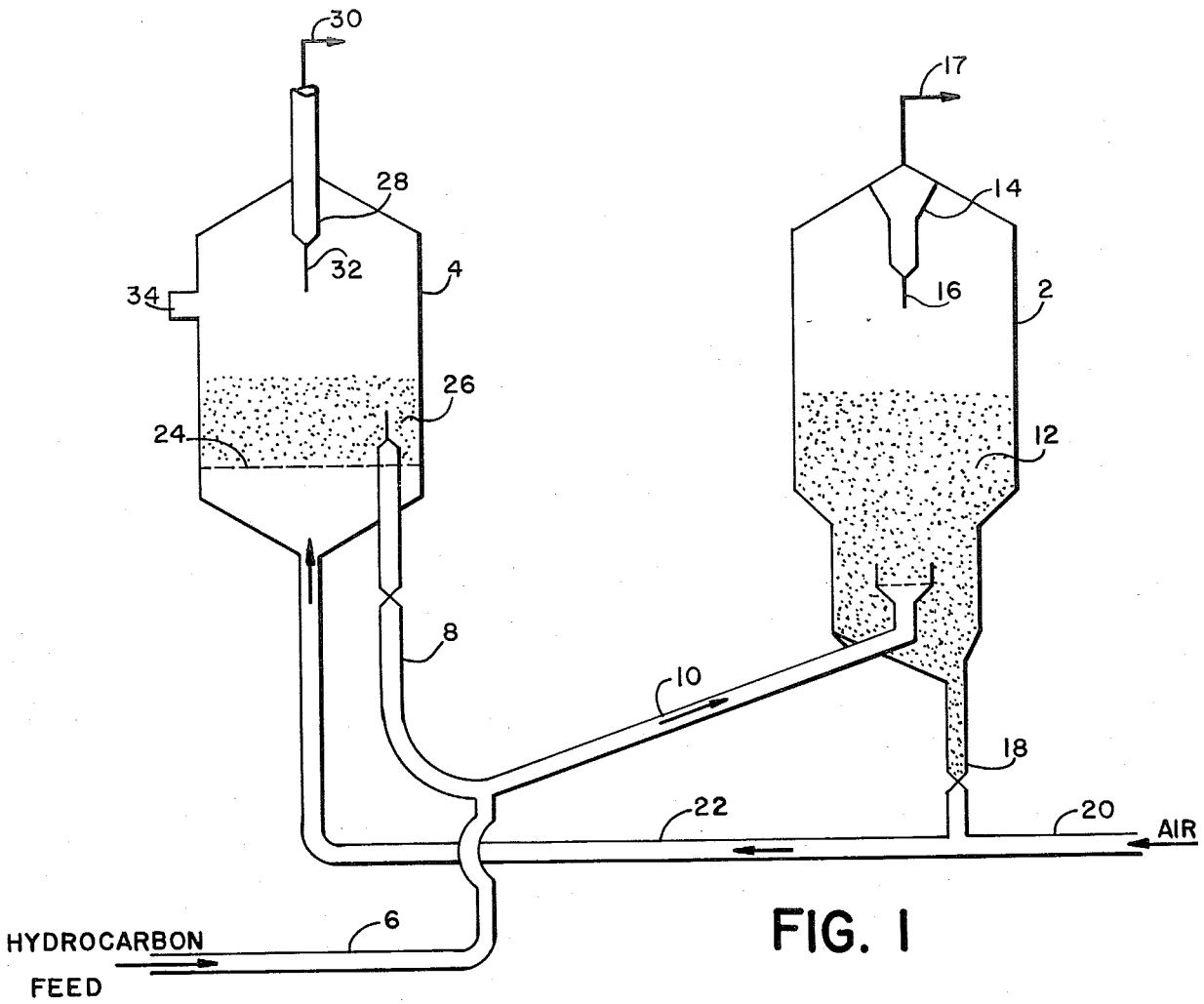

In referring to the drawing, a fluid catalytic cracking unit consists primarily of a reactor 2 and a regenerator 4 interconnected by a series of pipes (lines) which will be described. In operation, a hydrocarbon feedstock is introduced through line 6 and comes in contact with hot, regenerated catalyst (1,000° to 1,400° F.) which is withdrawn from regenerator 4 via line 8. The hot catalyst causes the hydrocarbon feedstock to be vaporized, and the resultant vapor-catalyst mixture is carried by riser 10 to reactor 2 for discharge therein. In reactor 2, the vaporized feed and catalyst mixture comes in contact with additional catalyst 12 (which may be from 8 to 100 tons depending on the size of the unit) and is converted to product. The hydrocarbon conversion product is conveyed upwardly in reactor 2, and the catalyst component separated from the product hydrocarbon in cyclone separator 14 with the catalyst falling back into reactor 2 through line 16 and the product hydrocarbon being withdrawn through line 17.

Carbonaceous material unavoidably is deposited upon the surface of the hydrocarbon conversion catalyst 12 in reactor 2, and therefore must be removed periodically for regeneration. Spent catalyst is withdrawn typically at a rate to effect recycling every 2–10 minutes through line 18 and is contacted with an oxidizing gas, e.g. air, being introduced to the system via line 20. The spent catalyst-air mixture is conveyed by line 22 to regenerator 4 where it is dispersed within regenerator 4 by means of a grid 24. There, the carbonaceous material is oxidized from the catalyst to form a regenerated catalyst 26. Carbon dioxide, carbon monoxide, and other combustion gases are separated from the hydrocarbon conversion catalyst by means of cyclone separator 28. The combustion gases (including some promoter) are withdrawn through line 30 and the regenerated catalyst returned to regenerator 4 through line 32. Makeup catalyst is charged to regenerator 4 through line 34.

In practicing this invention, the finely divided, promoter is diluted with makeup hydrocarbon conversion catalyst or added separately to produce the results desired. The promoter comprises from about 500 ppm to about 1% by weight of a metal selected from the group consisting of Group V, Group VI, and Group VIII metals having an atomic number of from 24 through 78, which is carried on a catalytic support, preferably gamma alumina. The Group V, Group VI, and Group VIII metals generally are good oxidation catalysts and can promote the oxidation of carbonaceous material from the hydrocarbon conversion catalyst, e.g. cracking catalyst. Quantities of metal of less than about 500 ppm require greater quantities of promoter to effect regeneration of the catalyst and thus limit the flexibility of operation. Quantities greater than about 1% metal tend to be less advantageous for reasons of economy and too high concentrations require higher addition rates to achieve the same effectiveness as promoters having lower concentrations of metal. For example, at 1% metal concentrations, it may be necessary to operate at 50 ppm metal based on the catalyst as compared to 3 ppm at lower levels.

The promoter is added to the regenerator in sufficient proportion to be effective for enhancing the oxidation of carbonaceous materials from the catalyst, but insufficient to adversely affect the performance of the catalyst in the reactor section. Generally, sufficient promoter is provided to the regenerator to provide from about 0.03 to 50 ppm and preferably from about 0.1 to 1 ppm metal by weight of the total catalyst present in the system, i.e. the catalyst in the regenerator and in the reactor. Quantities of promoter which provide concentrations of metal in a proportion greater than about 50 ppm may interfere with the overall performance characteristics of the hydrocarbon conversion catalyst, whereas lesser quantities of catalysts enhance the removal of carbonaceous material but do not interfere with the performance thereof. Additionally, once the unit is in a fully promoted state, i.e. the $CO_2/CO$ ratio is infinite greater quantities of promoter need not be added.

Although these proportions of promoter are commonly used, generally the procedure for addition, is to add appropriate catalyst to obtain the desired regenerator temperature and/or carbon dioxide/carbon monoxide ratios. When temperatures or heat become excessive in the regeneration, one simply cuts back on the amount of promoter and this increases the quantity of carbon monoxide. Where temperature or heat is not a problem, one can move to a fully promoted system and obtain an infinite $CO_2/CO$ ratio. This flexibility of operation is one of the advantages of the present promoter over conventional large diameter oxidation promoters and promoted catalyst. These latter systems cannot be adjusted with the facility of the present invention.

In the operation of a fluid catalytic cracking unit, it is preferred to use a promoter which contains platinum, palladium, or mixtures of the same, as the oxidizing metal. Preferably, the promoter will contain a mixture of platinum and palladium with the platinum being present in a greater proportion than the palladium, and more preferably in a ratio of from about 1.5–4.0:1 by weight. The concentration of platinum and palladium generally incorporated into the promoter preferably is from about 1500 to 4500 ppm, but broadly from 500 ppm to 1% by weight (including support).

The other component of the promoter is a support for the Group V, Group VI, or Group VIII metal, and it can be a conventional support such as clay, crystalline alumino-silicate, activated alumina, silica, silica-alumina and mixtures thereof. Quite often it is desirable to select a support that is different from the support used for the hydrocarbon conversion catalyst. By doing so, one often can obtain greater flexibility of operation, e.g. short or long residence time. We have found that it is advantageous to use an activated alumina, e.g. gamma alumina, as the catalyst support as it is frangible and permits removal of the promoter from the FCC unit within a period of a few hours. The significance of quick removal is manifest where a variety of hydrocarbon feedstocks are being processed and the regeneration temperature or ratio of carbon dioxide to carbon monoxide must be changed accordingly.

The promoter is finely divided, generally having a particle size of from about 10 to 150 microns, and more preferably of from about 20 to 100 microns. The advantage of using finely divided catalyst is that it can move freely in its fluidized state while in the regenerator to effect greater removal of carbonaceous material from the catalyst. Because of the ability to move about in the regenerator, it is possible to use substantially less promoter than would normally be utilized where the promoter is impregnated on extremely large diameter particles, e.g. Burl saddles and Raschig rings. As a result of the finely divided nature of the material, it too, along with the hydrocarbon conversion catalyst is conveyed to the reactor and then back to the regenerator rather than being retained in the regenerator itself.

In this process, virtually any hydrocarbon conversion catalyst, e.g. those used in fluid catalytic cracking units, hydroforming, alkylation, dealkylation, can be used with the promoter. Typically, the hydrocarbon conversion catalysts are crystalline alumino-silicates commonly referred to as zeolites. These catalysts are well-known, and examples of such catalysts are sold under the trademark HOUDRY ®, HFZ catalysts.

The following examples are intended to illustrate preferred embodiments of the invention and are not intended to restrict the scope thereof. All percents and all parts are expressed as a function of weight unless otherwise specified.

EXAMPLE 1

A riser cracking unit operating with a conventional regenerator was used to process a hydrocarbon feed. The reactor had been operating at 926° F., with the regenerator dense phase operating at a temperature of 1222° F. and the dilute phase at 1242° F. The flue gas temperature in the regenerator was 1249° F. and the flue gas $CO_2/CO$ ratio on a volume basis was 2.5:1. The cracking unit employed a HOUDRY ® HFZ-20 cracking catalyst which is a crystalline alumino-silicate.

It was found that one could eliminate the heat deficiency in the regenerator and thereby minimize the amount of fuel that was burned to maintain the heat balance by injecting a promoter into the regenerator unit. The promoter employed was a dust containing approximately 4200 ppm platinum and palladium with the platinum/palladium ratio being about 3.5/1. The platinum and palladium metal was deposited on a gamma alumina support. The particle size of the promoter was about 66 microns (average) and the density was about 0.83 grams per $cm^3$.

The promoter was added by way of the fresh catalyst makeup system into the regenerator. The addition was controlled by monitoring the $\Delta T$ between the flue gas temperature and the dense bed temperature in the regenerator. Normally, the flue gas temperature was 50° to 60° F. above the dense bed temperature. On addition of promoter, the flue gas temperature started to decrease rapidly and settled about 75° F. below the dense bed level. Within 30 minutes the $CO_2/CO$ ratio was infinite. The amount of promoter added to the unit calculated to be about 40 pounds per 100 tons of catalyst or stated another way, calculated to provide about 0.3 to 0.5 ppm by weight platinum and palladium based on the total weight of catalyst.

A product analysis was made before and after addition of the promoter and the following table provides these results.

TABLE 1

| OPERATING SUMMARY | | |
|---|---|---|
| Product Yields | BEFORE PROMOTER | AFTER PROMOTER |
| $C_2$ and LTR, SCF/BBL | 278 | 273 |
| $C_3$-$C_4$, Vol % | 20.3 | 21.0 |
| Gasoline, Vol % | 64.3 | 65.9 |
| Light Cycle Oil, Vol % | 13.3 | 9.4 |
| Slurry Oil, Vol % | 3.5 | 4.5 |
| Coke, Wt % | 6.4 | 5.2 |
| Conversion, Vol % | 83.2 | 86.1 |

The results clearly indicate that the addition of the platinum-palladium promoter rapidly enhanced removal of carbonaceous material from the catalyst and effected substantially complete combustion in the regenerator. This complete combustion permitted an appropriate heat balance to be maintained without requiring additional fuel.

Termination of the promoted system was effected simply by ceasing addition of promoter to the regenerator. The friable nature of the promoter permitted removal of the promoter with the flue gas. The time for substantially complete conversion to an unpromoted system was about two hours.

EXAMPLE 2

A modified riser cracker employing a feed preheater, an electrostatic precipitator and a carbon monoxide boiler was used to process hydrotreated feed over a HOUDRY ® HFZ-30$^{TM}$ catalyst. The unit had been operating in a heat deficient mode and great quantities of fuel were required to maintain the heat balance.

A promoter identical to that in Example 1 was added to the unit to enhance conversion of the carbon monoxide to carbon dioxide in the regenerator. The level of addition of promoter provided about 0.1 ppm platinum and palladium based on the weight of the catalyst in the system. Immediate response was observed and the $CO_2/CO$ ratio was 50 within about 30 minutes.

Operating data are set forth in Table II below:

| Operating Conditions | Before Promoter | After Promoter |
|---|---|---|
| Feed | 580° F. | 577° F. |
| Reactor | 943° F. | 940° F. |
| Regenerator dense bed | 1158° F. | 1184° F. |
| Flue Gas Temperature | 1195° F. | 1155° F. |
| Flue Gas $CO_2/CO$ (Volume) | 2.0 | 50.0 |
| $O_2$ constant air rate* | 0.3 | 1.5 |
| Conversion | 67 | 70 |
| Torch Oil | Yes | Reduced |
| Carbon on Regenerated Catalyst wt % | 0.48 | <0.2 |

*Excess oxygen

What is claimed is:

1. In a fluid catalytic cracking unit wherein a hydrocarbon feedstock is contacted in a reactor with a mass of a fluidized, finely divided zeolite catalyst, and converted to a hydrocarbon product, the hydrocarbon product separated from the catalyst, and the catalyst sent to a regenerator for effecting removal of carbonaceous material deposited on said catalyst, the improvement for enhancing the removal of carbonaceous material from the catalyst while in said regenerator without substantially affecting the performance of the catalyst which comprises:

fluidizing in physical admixture with the catalyst, finely divided frangible promoter particles comprising from about 500 parts per million to about 1% of a metal selected from the group consisting of platinum, palladium and mixtures thereof carried on a gamma alumina support in an amount to provide from about 0.15–50 parts per million metal by weight of the zeolite catalyst.

2. The process of claim 1 wherein said promoter is included in a proportion sufficient to provide from about 0.1 to 1 ppm metal based on the weight of the catalyst.

3. The process of claim 2 wherein said metal in said promoter is a mixture of platinum and palladium.

4. The process of claim 2 wherein the particle size of the promoter is from about 20 to 80 microns.

* * * * *

UNITED STATES PATENT AND TRADEMARK OFFICE

CERTIFICATE OF CORRECTION

PATENT NO. : 4,222,856
DATED : September 16, 1980
INVENTOR(S) : John Herman Hansel, et al It is certified that error appears in the above—identified patent and that said Letters Patent is hereby corrected as shown below:

Claim 1 line 18, delete --0.15-- and insert "0.1.".

Signed and Sealed this

*Second* Day of *February 1982*

[SEAL]

*Attest:*

GERALD J. MOSSINGHOFF

*Attesting Officer*

*Commissioner of Patents and Trademarks*